US007028699B2

(12) United States Patent
Lee

(10) Patent No.: US 7,028,699 B2
(45) Date of Patent: Apr. 18, 2006

(54) TILTING UMBRELLA WITH ADJUSTABLE COVER

(76) Inventor: Youth Lee, 13F, No. 232, Sec. 3, Bar Der Road, Taipei City (TW)

( * ) Notice: Subject to any disclaimer, the term of this patent is extended or adjusted under 35 U.S.C. 154(b) by 35 days.

(21) Appl. No.: 10/936,546

(22) Filed: Sep. 9, 2004

(65) Prior Publication Data

US 2006/0048805 A1 Mar. 9, 2006

(51) Int. Cl.
*A45B 11/00* (2006.01)

(52) U.S. Cl. ..... 135/20.1; 135/19.5; 135/20.3; 403/122; 403/143; 464/106

(58) Field of Classification Search ..... 135/20.1, 135/19.5, 27, 20.3; 403/122, 137, 134–135, 403/141–143; 464/106, 139, 141–143, 156–159, 464/173

See application file for complete search history.

(56) References Cited

U.S. PATENT DOCUMENTS 1,996,071 A * 4/1935 Kahn ..... 135/20.1
2,971,770 A * 2/1961 Wagner ..... 280/124.134
4,856,795 A * 8/1989 DeLano et al. ..... 277/635
5,086,797 A * 2/1992 Earnshaw et al. ..... 135/20.1
5,590,673 A * 1/1997 Earnshaw ..... 135/20.1
5,782,574 A * 7/1998 Henkel ..... 403/135
5,901,721 A * 5/1999 Sadeghvaziri ..... 135/16
6,290,606 B1 * 9/2001 Hodson ..... 464/159
6,761,180 B1 * 7/2004 Lai ..... 135/20.3

FOREIGN PATENT DOCUMENTS

FR 2841750 * 1/2004

* cited by examiner

*Primary Examiner*—Winnie Yip
(74) *Attorney, Agent, or Firm*—Rosenberg, Klein & Lee

(57) ABSTRACT

A tilting umbrella with an adjustable cover includes an adjustable cover and a shaft. An upper joint is provided centrally of the cover having a positioning ball to be received in an upper connector formed on top of the shaft. Hence, the cover is adjustable to have an oblique angle relating to the shaft as desired for sheltering sunshine from any directions effectively.

3 Claims, 8 Drawing Sheets

TILTING UMBRELLA WITH ADJUSTABLE COVER

BACKGROUND OF THE INVENTION

It is known that a conventional tilting umbrella has a shaft connecting with a large frame and cover on top end for sheltering from sunshine. The cover stands just on top at fixed position that can shelter from only one shining direction of the sun. When in morning or evening, the conventional umbrella is poor of work since the sunshine comes from slant angle. The fixed umbrella is thus without utility. Some improvements are designed for overcoming the drawback of the prior art, such as U.S. Pat. No. 2,724,396. The said Patent provides a tilting pole on upper portion of its shaft in order that makes its cover be bent with an oblique angle for adjusting to a direction relating to sunshine. The effect for sheltering sunshine is well but the structure of the Patent is somehow complexity and is lack of utilization.

SUMMARY OF THE INVENTION

The present invention is to provide a tilting umbrella, which improves its adjusting apparatus for obtaining a confirmed and efficient practice of use. Now, accompanying with the following drawings, the character of the present invention will be described here and after.

DETAILED DESCRIPTION OF THE PREFERRED EMBODIMENT

Figure 1:
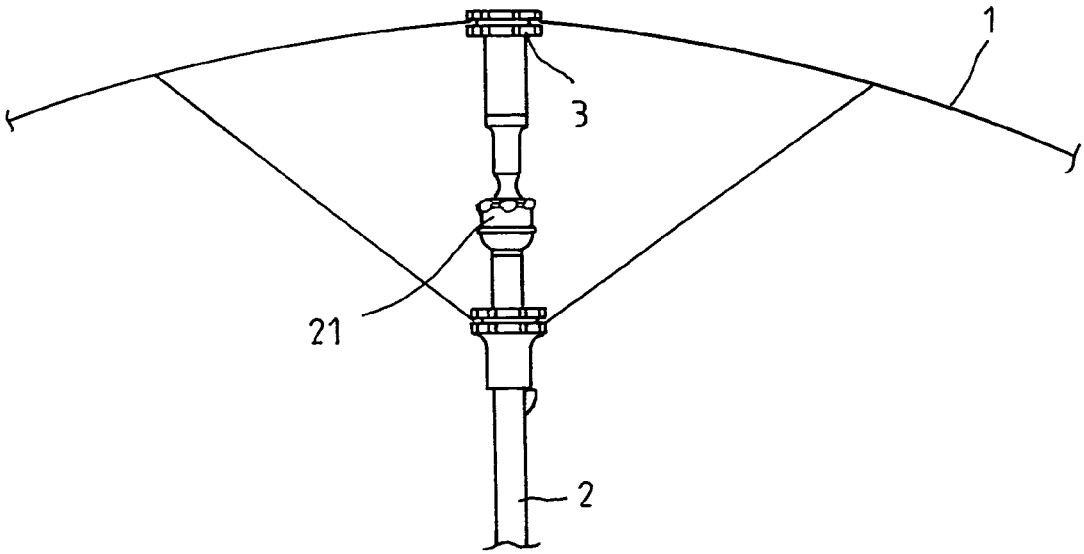
FIG. 1 is a plan view showing a part of a tilting umbrella in normal use according to the present invention.
Figure 2:
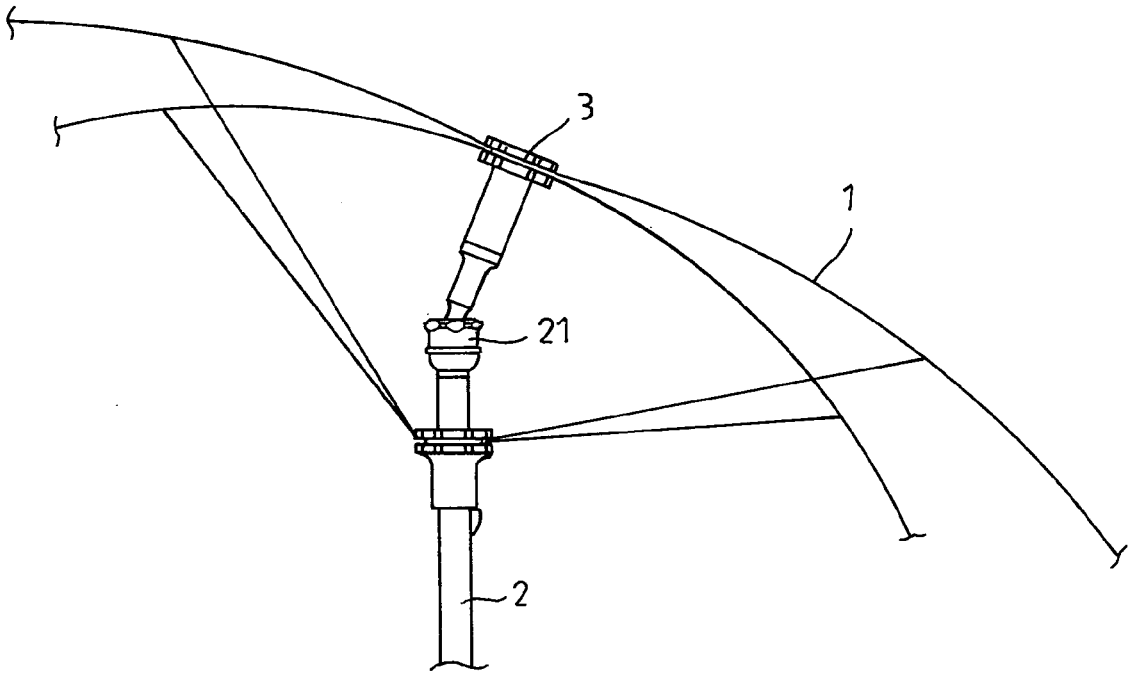
FIG. 2 is a plan view showing the tilting umbrella being oblique with an angle relating to its shaft of FIG. 1.

Please referring to FIGS. 1 and 2, the present invention relates to an adjusting apparatus of a tilting umbrella, which includes an adjustable cover (1) and a shaft (2). An upper joint (3) provided centrally of the cover (1) has a bottom ball (31) to be received in an upper connector (21) formed on top of the shaft (2). In which, the cover (1) is adjustable to have an oblique angle relating to the shaft (2) as desired.

Referring to 3 to 6, the adjusting apparatus includes the bottom ball (31) of the upper joint (3) and the upper connector (21) of the shaft (2). The ball (31) is provided with a positioning groove (311) at bottom plane while several arcs (312) are formed around the groove (311). An annular concave (313) is formed around the arcs (312) and a flange (314) is provided. The connector (21) has an inner protrusion (211) and several ribs (212) formed at inner surface being longitude, each of which is provided with a cut (213).

Figure 5:
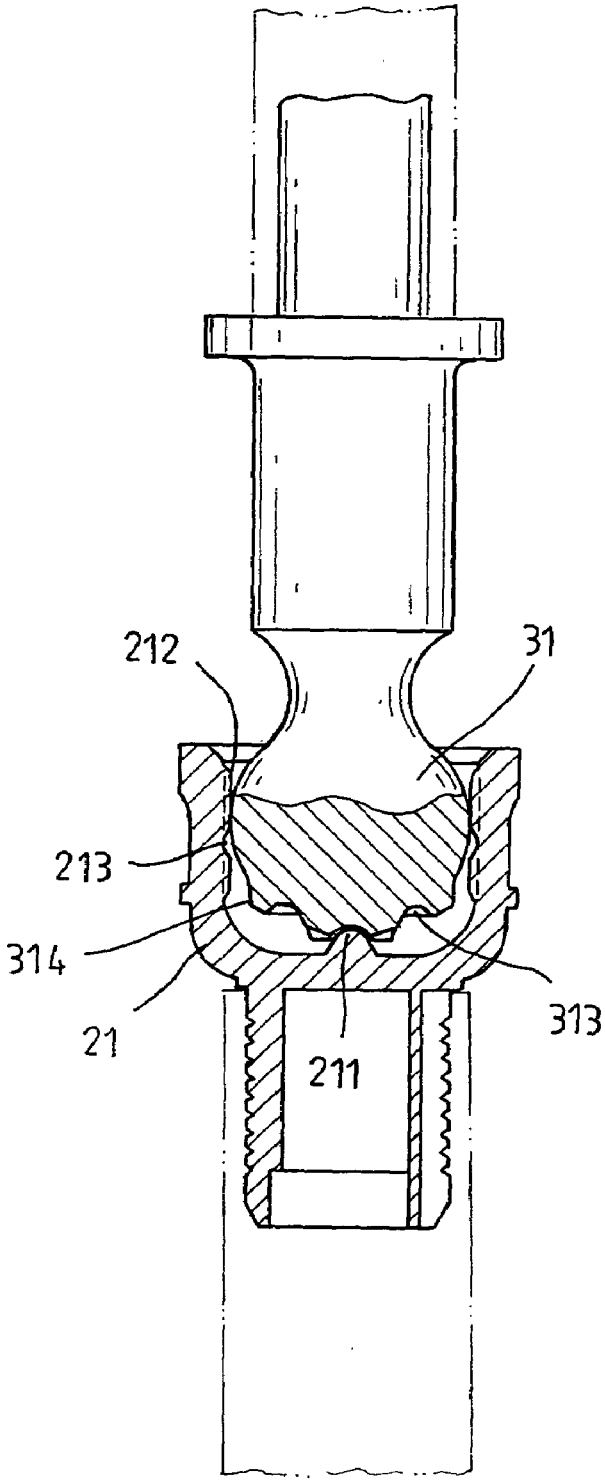
FIG. 5 is a cross-sectional plan view of FIG. 4.

As the positioning ball (31) is received in the connector (21), the groove (311) will just engage with the protrusion (211), as shown in FIG. 5, while the outside surface of the ball (31) is pressed by the ribs (212) firmly. At this state, the umbrella is in its normal use just as shown in FIG. 1.

Figure 6:
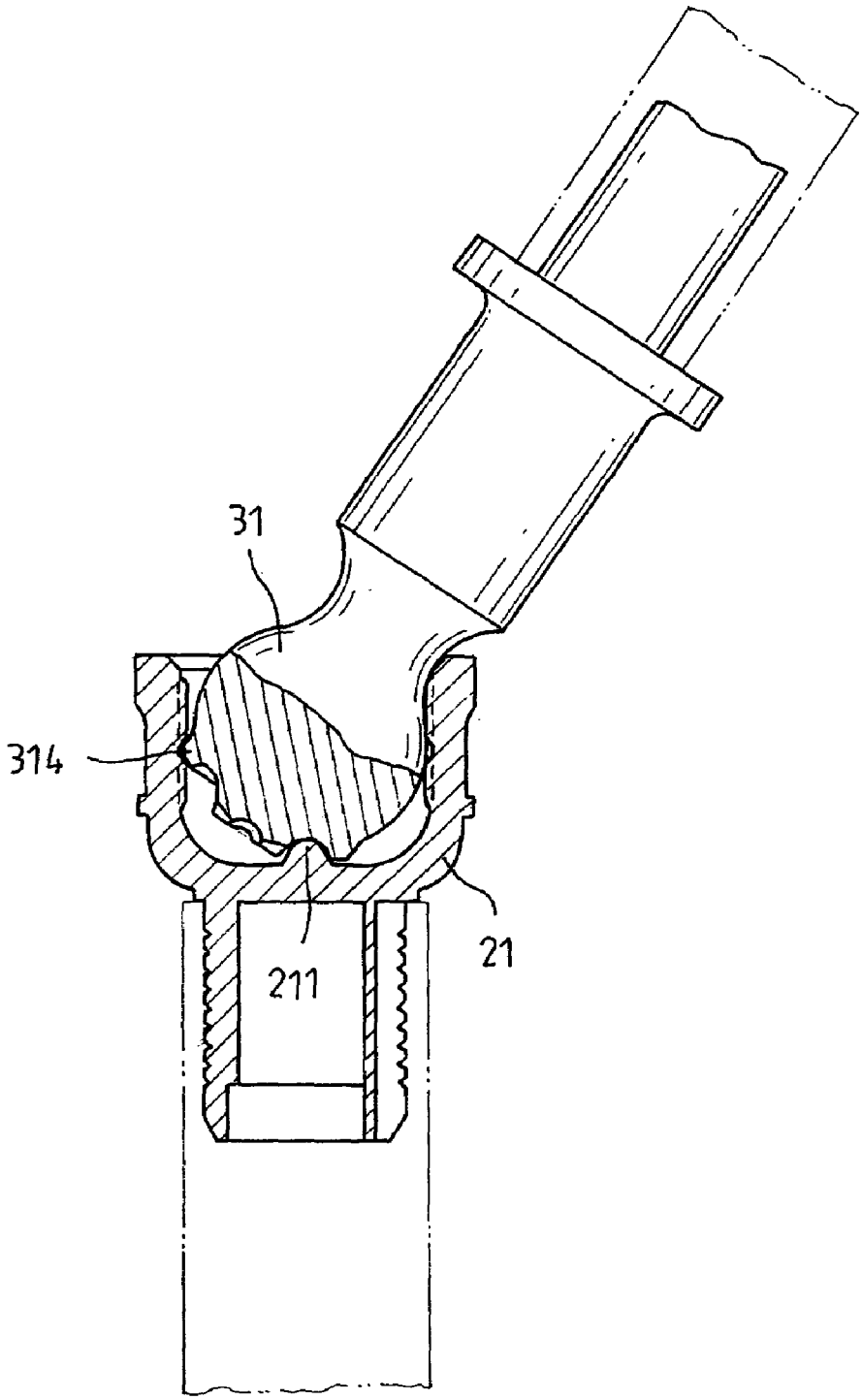
FIG. 6 is a plan view showing oblique state from FIG. 5.

When sunshine comes from slant directions, the perpendicular umbrella cannot provide effective sheltering purpose. The present invention can easily bend its upper joint (3) being oblique to let the cover (1) facing the direction of the sunshine that facilitates the effect of tilting. At this moment, the ball (31) has changed its position, as in FIG. 6, that the protrusion (211) is engaged within the annular concave (313) while the flange (314) is engaged with the cut (213) of a related rib (212). The position of such engagement will be secured and the cover (1) is still being capable of rotating to any angle relating to the shaft for sheltering sunshine from any direction.

Figure 3:
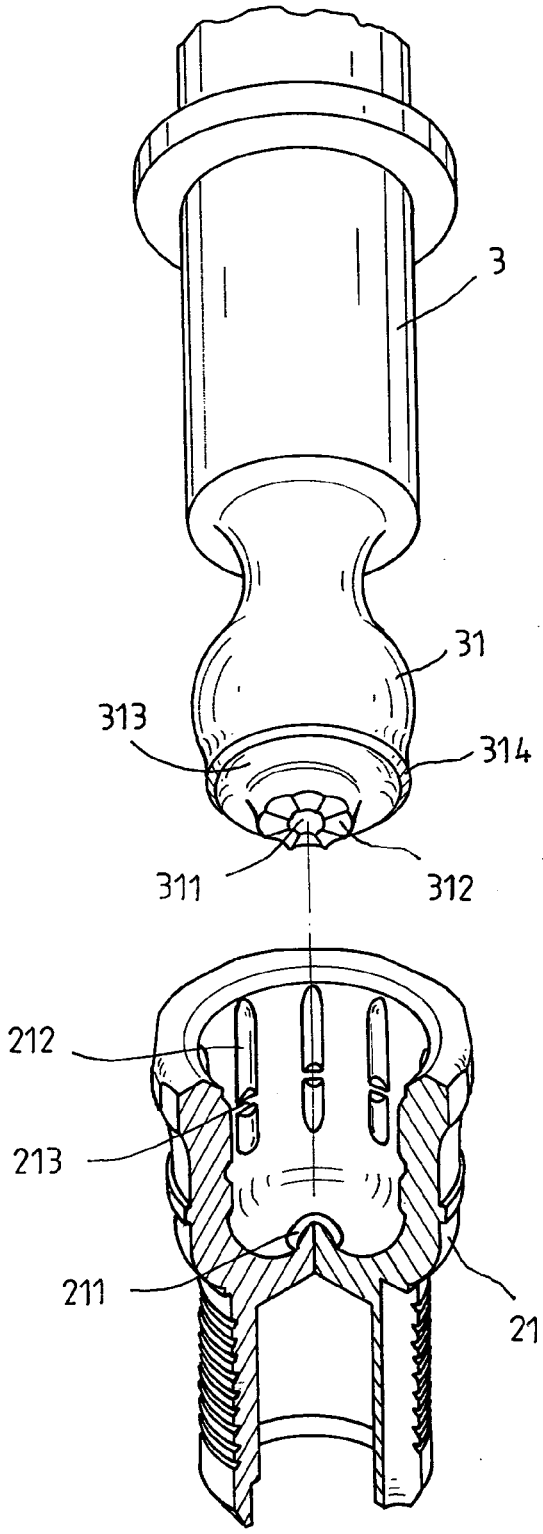
FIG. 3 is an exploded perspective view showing adjusting apparatus according to the present invention.
Figure 4:
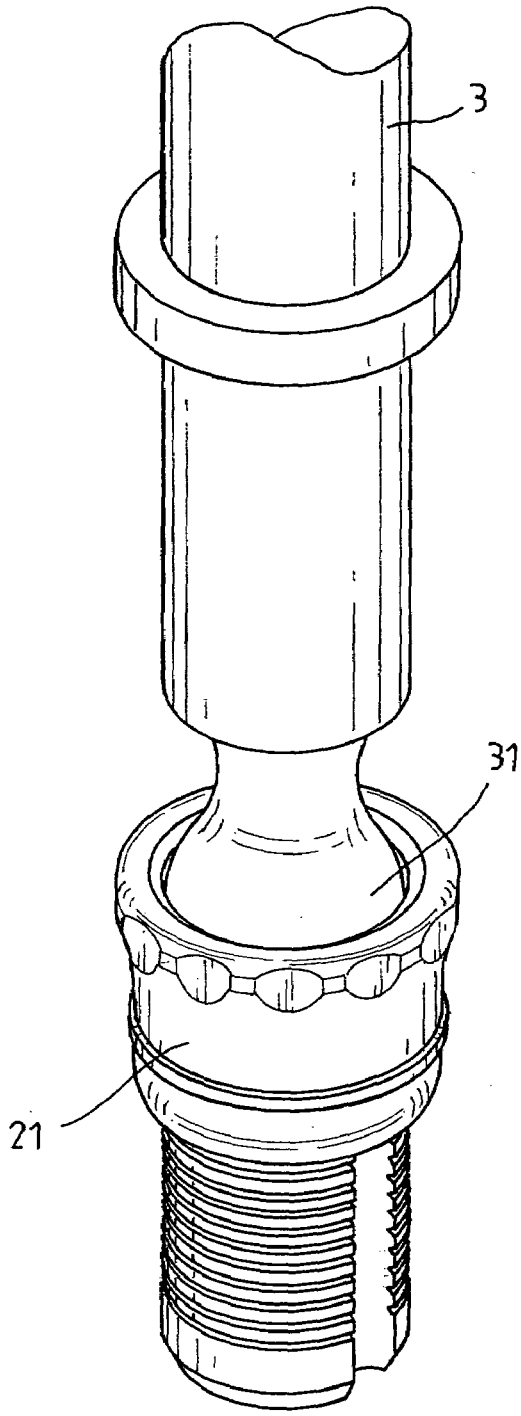
FIG. 4 is an assembled view of FIG. 3.
Figure 7:
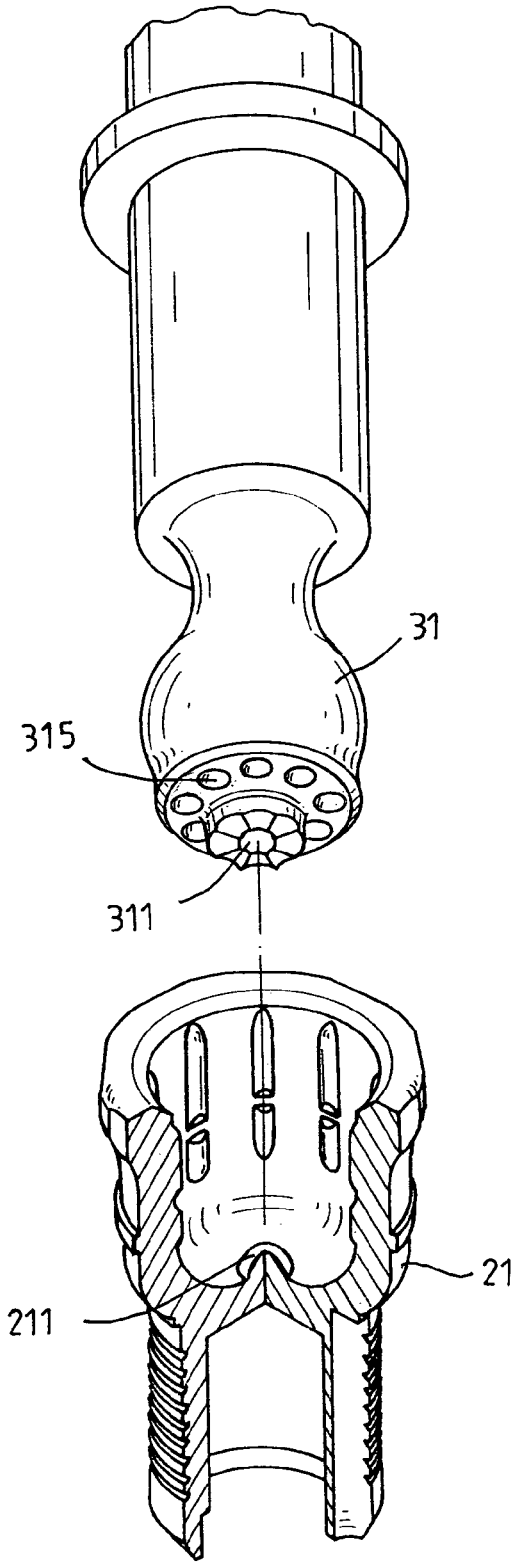
FIG. 7 is a perspective view showing another embodiment of tilting apparatus according to the present invention.
Figure 8:
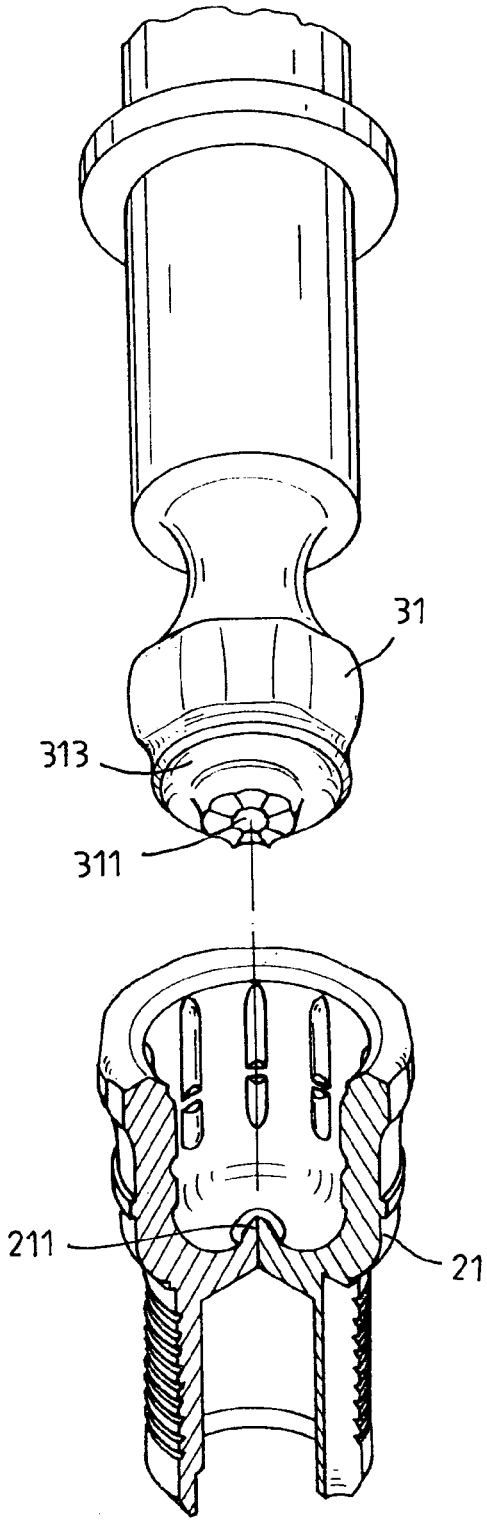
FIG. 8 is a modified embodiment relating to the apparatus of FIG. 3.
Figure 9:
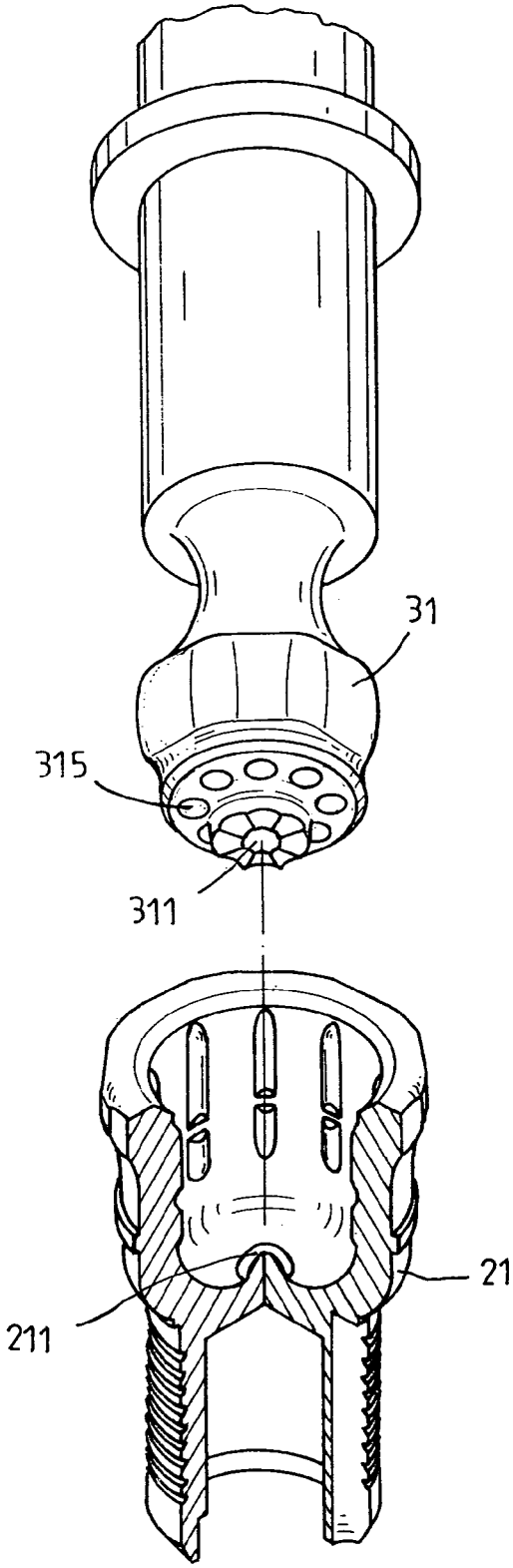
FIG. 9 is a modified embodiment relating to the apparatus of FIG. 7.

As shown in FIG. 7, it is another embodiment of this invention that uses several apertures (315) to replace the annular concave (313), which obtains the same effect for positioning the protrusion (211) as the cover is in oblique. FIGS. 8 and 9 are modified designs relating to the structure shown in FIGS. 3 and 7, wherein the positioning ball (31) is designed to have arched polygonal surfaces, which are also capable of being firmly positioned.

I claim:

1. A tilting umbrella with an adjustable cover including an adjustable cover and a shaft, an upper joint provided centrally of the cover having a bottom positioning ball to be received in an upper connector formed on top of the shaft, in which, the cover is adjustable to have an oblique angle relating to the shaft as desired; and improvements are:

the adjusting apparatus including the bottom positioning ball of the upper joint and the upper connector of the shaft, wherein the ball being provided with a positioning groove at bottom plane while several arcs being formed around the groove, an annular concave being formed around the arcs and a flange being provided; the connector having an inner protrusion and several ribs formed at inner surface being longitude, each of which is provided with a cut.

2. The tilting umbrella with an adjustable cover as claimed in claim 1, wherein several apertures are provided to instead of the annular concave of the positioning ball.

3. The tilting umbrella with an adjustable cover as claimed in claim 1, wherein the positioning ball is provided with outside surface having arched polygonal planes.

* * * * *